US009498087B1

(12) United States Patent
Mokhtare et al.

(10) Patent No.: US 9,498,087 B1
(45) Date of Patent: Nov. 22, 2016

(54) ADJUSTABLE INFANT BATHING CHAIR

(71) Applicants: Shahin Mokhtare, Pasadena, CA (US); Retno Suryandari, Pasadena, CA (US)

(72) Inventors: Shahin Mokhtare, Pasadena, CA (US); Retno Suryandari, Pasadena, CA (US)

( * ) Notice: Subject to any disclaimer, the term of this patent is extended or adjusted under 35 U.S.C. 154(b) by 0 days.

(21) Appl. No.: 14/734,084

(22) Filed: Jun. 9, 2015

(51) Int. Cl.
*A47K 3/024* (2006.01)
*A47K 3/12* (2006.01)
*A47D 15/00* (2006.01)

(52) U.S. Cl.
CPC ..... *A47K 3/122* (2013.01); *A47D 15/006* (2013.01)

(58) Field of Classification Search
CPC ..... A47K 3/02
USPC ..... 4/300–595
See application file for complete search history.

(56) References Cited

U.S. PATENT DOCUMENTS 2,379,340 A * 6/1945 Corbett ..... A47K 3/127 4/572.1
2,807,028 A * 9/1957 Cavanaugh ..... A47K 3/034 4/659
3,086,222 A * 4/1963 Hall ..... A47K 3/122 297/353
3,545,016 A * 12/1970 Schorken ..... A47K 3/127 4/572.1
D266,940 S * 11/1982 Roslan ..... A47K 3/127 4/572.1
4,766,620 A * 8/1988 Boyhan ..... A45D 19/00 4/516
4,938,603 A * 7/1990 Turner ..... A47D 1/02 297/153
5,007,119 A * 4/1991 Yamaguchi ..... A47D 13/08 4/523
5,092,001 A * 3/1992 Ross ..... A47K 3/034 4/559
5,321,859 A * 6/1994 Buckshaw ..... A47K 3/127 297/467
5,599,063 A * 2/1997 Lister ..... A47D 1/002 297/256.11
5,687,433 A * 11/1997 Garner ..... A47K 3/127 297/256.15
6,785,917 B1 9/2004 Bryant
2003/0184131 A1* 10/2003 Haney ..... A47C 4/20 297/55
2005/0091742 A1* 5/2005 Bennett ..... A47K 3/024 4/572.1
2009/0031490 A1* 2/2009 Kassai ..... A47K 3/127 4/572.1
2012/0030870 A1* 2/2012 Storm ..... A61G 5/1002 4/578.1
2012/0187732 A1* 7/2012 Lerm ..... A47C 7/744 297/219.12
2013/0319776 A1* 12/2013 Goldberg ..... A47C 31/126 177/144
2014/0359932 A1* 12/2014 Dutton ..... A47K 3/127 4/572.1
2015/0201814 A1* 7/2015 Todokoro ..... A47K 3/127 4/572.1
2015/0351558 A1* 12/2015 Visser ..... A47D 1/00 297/174 R

FOREIGN PATENT DOCUMENTS

CN 203468116 U 3/2014

* cited by examiner

*Primary Examiner* — Lori Baker
(74) *Attorney, Agent, or Firm* — Kyle A. Fletcher, Esq.

(57) ABSTRACT

The adjustable infant bathing chair is a chair that can be placed in a bathtub and used to wash infants. The adjustable infant bathing chair has the general appearance of a baby swing. The adjustable infant bathing chair has a plurality of nonskid feet that allow the adjustable infant bathing chair to be placed directly in a bathtub. The infant is then placed in the chair. With the chair supporting the infant, the caretaker does not need to worry about the infant slipping into the water and can focus on cleaning the infant. The adjustable infant bathing chair is adjustable for height and has a seatbelt to secure the infant. The adjustable infant bathing chair comprises a structure, a seat frame, a plurality of struts, a plurality of T connectors, a plurality of nonskid feet, and a seatbelt.

9 Claims, 6 Drawing Sheets

ADJUSTABLE INFANT BATHING CHAIR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of Highchairs and Baby Chairs, more specifically, a chair configured for use in bathing an infant.

SUMMARY OF INVENTION

The adjustable infant bathing chair is a chair that can be placed in a bathtub and used to wash infants. The adjustable infant bathing chair has the general appearance of a baby swing. The adjustable infant bathing chair has a plurality of nonskid feet that allow the adjustable infant bathing chair to be placed directly in a bathtub. The infant is then placed in the chair. With the chair supporting the infant, the caretaker does not need to worry about the infant slipping into the water and can focus on cleaning the infant. The adjustable infant bathing chair is adjustable for height and has a seatbelt to secure the infant.

These together with additional objects, features and advantages of the adjustable infant bathing chair will be readily apparent to those of ordinary skill in the art upon reading the following detailed description of the presently preferred, but nonetheless illustrative, embodiments when taken in conjunction with the accompanying drawings.

In this respect, before explaining the current embodiments of the adjustable infant bathing chair in detail, it is to be understood that the adjustable infant bathing chair is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the adjustable infant bathing chair.

It is therefore important that the claims be regarded as including such equivalent construction insofar as they do not depart from the spirit and scope of the adjustable infant bathing chair. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention.

They are meant to be exemplary illustrations provided to enable persons skilled in the art to practice the disclosure and are not intended to limit the scope of the appended claims.

DETAILED DESCRIPTION OF THE EMBODIMENT

Figure 1:
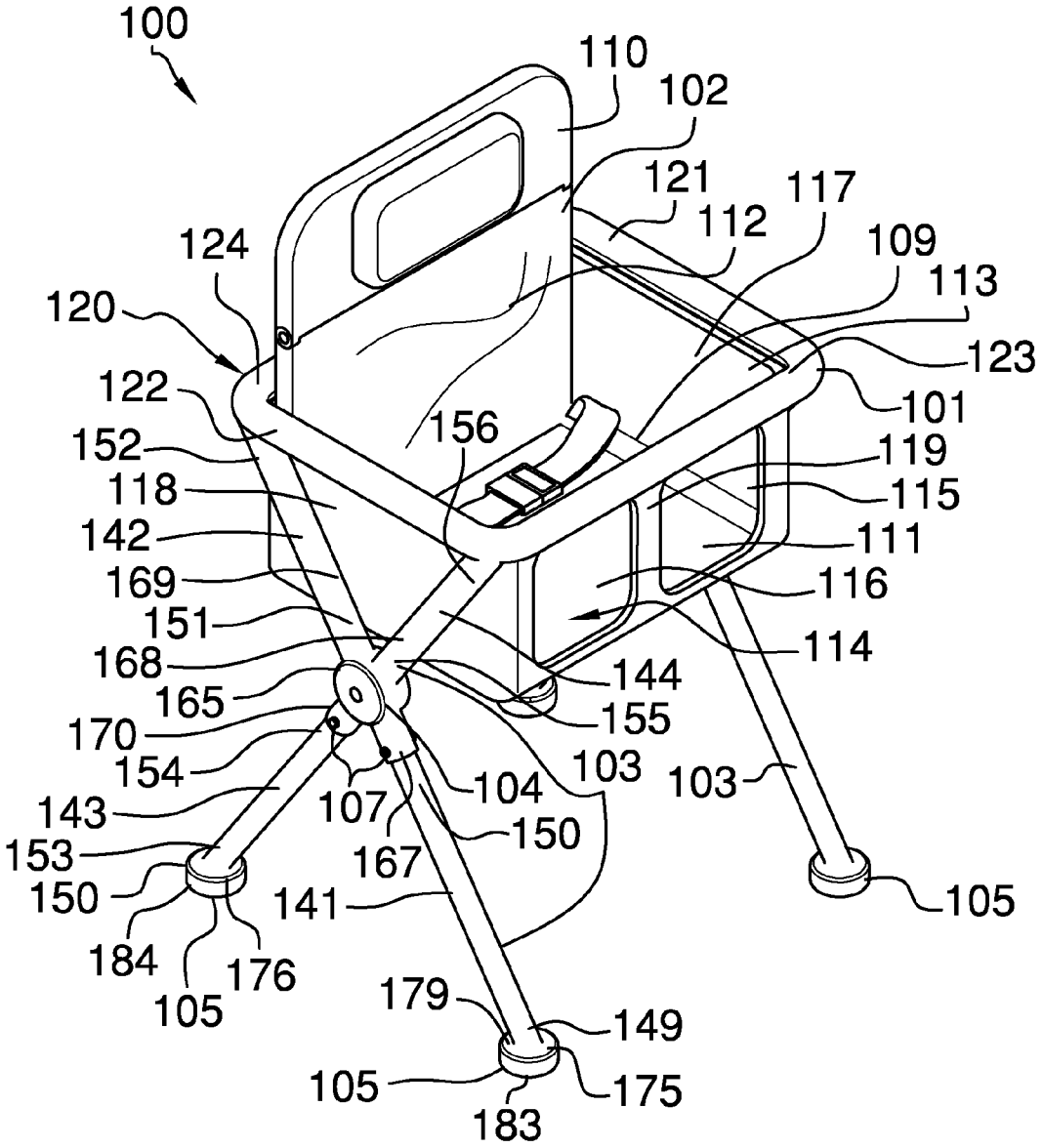
FIG. 1 is a perspective view of an embodiment of the disclosure.
Figure 2:
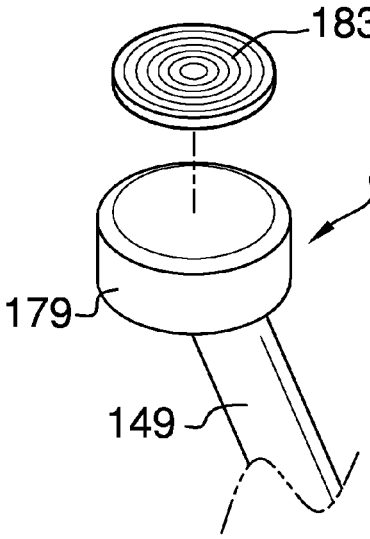
FIG. 2 is a detail view of an embodiment of the disclosure.
Figure 3:
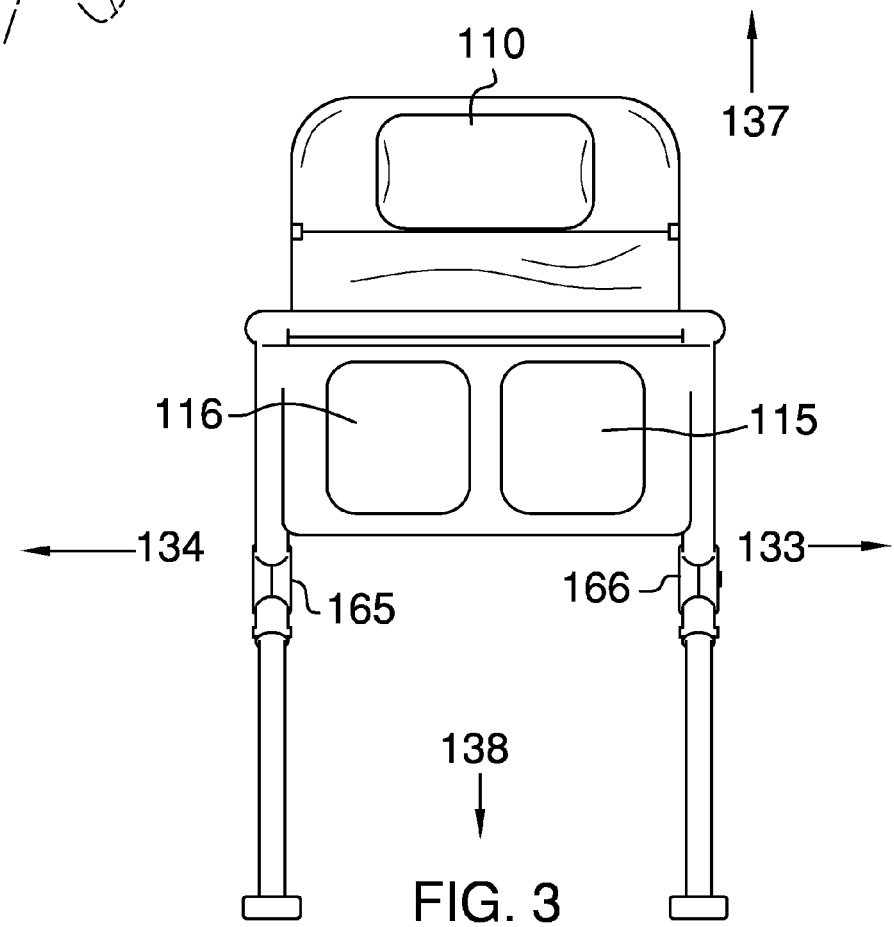
FIG. 3 is a front view of an embodiment of the disclosure.
Figure 4:
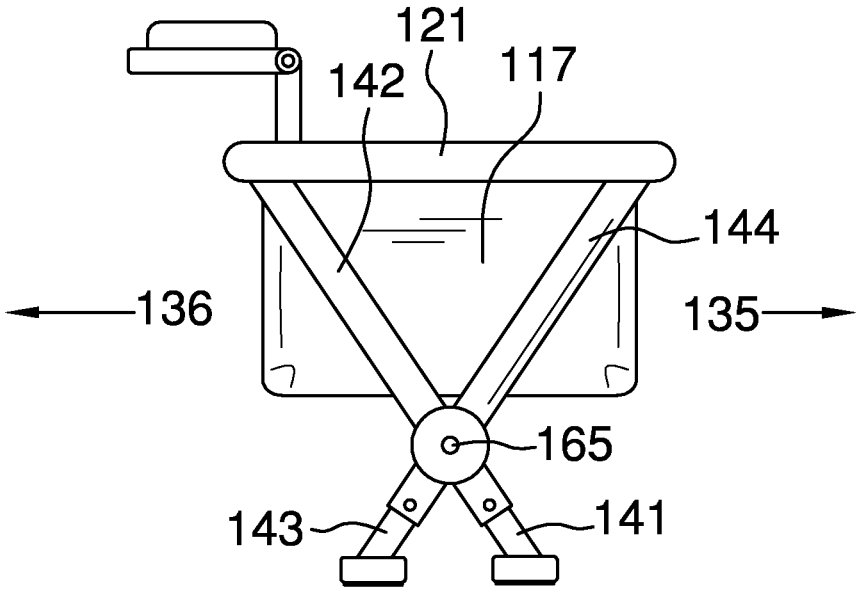
FIG. 4 is a side view of an embodiment of the disclosure.
Figure 5:
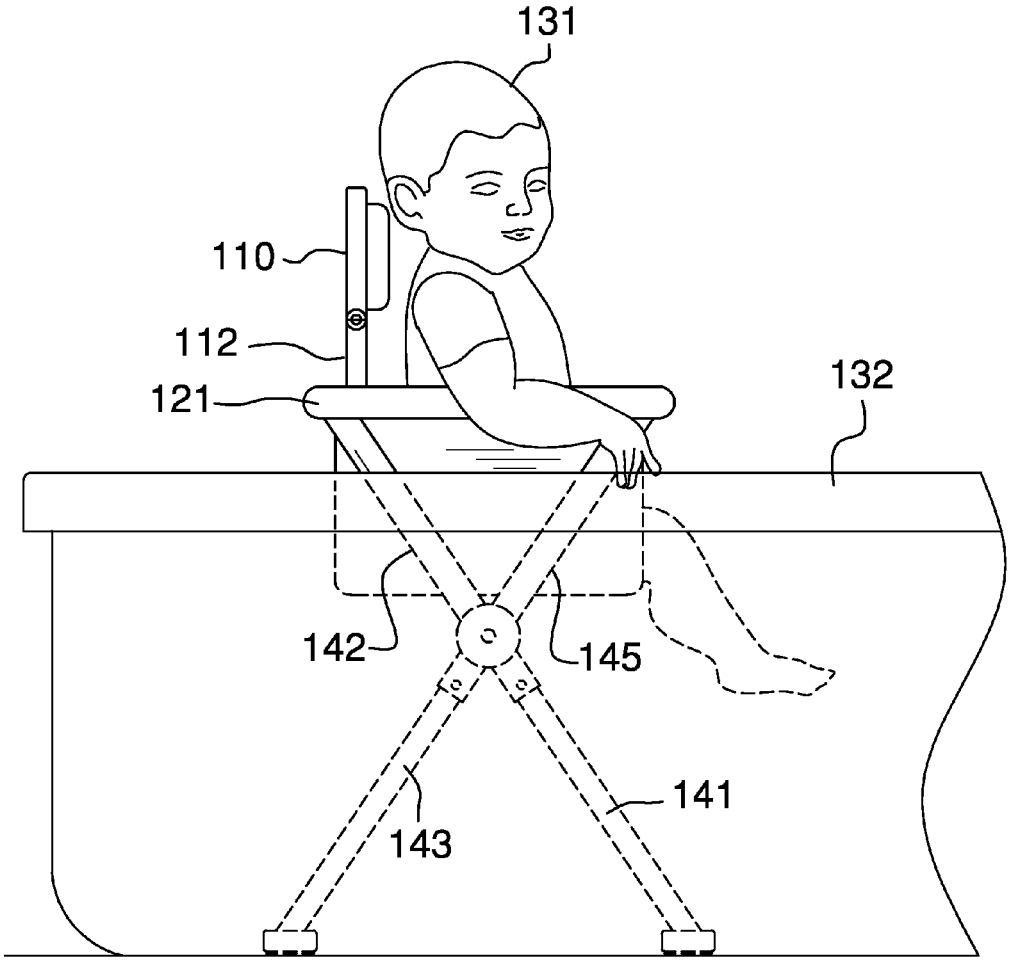
FIG. 5 is an in use view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 7. The adjustable infant bathing chair 100 (hereinafter invention) comprises a structure 101, a seat frame 102, a plurality of struts 103, a plurality of T connectors 104, a plurality of nonskid feet 105, and a seatbelt 106.

The structure 101 is fabricated as an open rectangular block into which the infant 131 can be placed. The structure 101 has an open top 113 and an open bottom 114. The purpose of the open top 113 is to allow the infant 131 to be placed into the structure 101. The purpose of the open bottom 114 is to allow the bath water to drain away from the infant 131 as the infant 131 is being bathed. The structure 101 is constructed with a left wall 117, a right wall 118, a front wall 119 and a back wall 120. The front wall 119 of the structure 101 is formed as a rectangular plate that has formed in it a left leg hole 115 and a right leg hole 116. The left wall 117, the right wall 118, and back wall 120 are each formed as a rectangular plate.

The top 137 side of the left wall 117 is formed with a left ridge 121 that projects perpendicularly away from left wall 117 in a direction away from the center of the structure 101. The top 137 side of the right wall 118 is formed with a right ridge 122 that projects perpendicularly away from right wall 118 in a direction away from the center of the structure 101. The top 137 side of the front wall 119 is formed with a front ridge 123 that projects perpendicularly away from front wall 119 in a direction away from the center of the structure 101. The top 137 side of the back wall 120 is formed with a back ridge 124 that projects perpendicularly away from back wall 120 in a direction away from the center of the structure 101.

The seat frame 102 comprises an aluminum frame 109 that is mounted into the interior of the structure 101 using commercially available hardware. The purpose of the seat frame 102 is to create a location where the infant 131 can be seated in the structure 101. In addition to the aluminum frame 109, the seat frame 102 further comprises a canvas seat 111, a canvas back support 112, and the headrest 110. The canvas seat 111 is a piece of canvas fabric that is mounted on the aluminum frame 109 and is used as a seat to suspend the infant 131 above the water. The canvas back support 112 is a piece of canvas fabric that is mounted on the aluminum frame 109 and is used to support the back 136 of the infant 131. The headrest 110 is a plastic plank that is covered in a cushioned material that is mounted on the aluminum frame 109 above the canvas back support 112. The purpose of the headrest 110 is to properly support the head of the infant 131. As a safety precaution, a seatbelt 106 is mounted on the seat frame 102 to secure the infant 131 in the seat frame 102.

The plurality of struts 103 further comprises a first strut 141, a second strut 142, a third strut 143, a fourth strut 144, a fifth strut 145, a sixth strut 146, a seventh strut 147, and an eighth strut 148. The first strut 141 is further defined with a ninth end 149 and a tenth end 150. The second strut 142 is further defined with an eleventh end 151 and a twelfth end 152. The third strut 143 is further defined with a thirteenth end 153 and a fourteenth end 154. The fourth strut 144 is further defined with a fifteenth end 155 and a sixteenth end 156. The fifth strut 145 is further defined with a seventeenth end 157 and an eighteenth end 158. The sixth strut 146 is further defined with a nineteenth end 159 and a twentieth end 160. The seventh strut 147 is further defined with a twenty first end 161 and a twenty second end 162. The eighth strut 148 is further defined with a twenty third end 163 and a twenty fourth end 164. The first strut 141 is sized to fit inside the second strut 142. The third strut 143 is sized to fit within the fourth strut 144. The fifth strut 145 is sized to fit within the sixth strut 146. The seventh strut 147 is sized to fit into the eighth strut 148.

Figure 6:
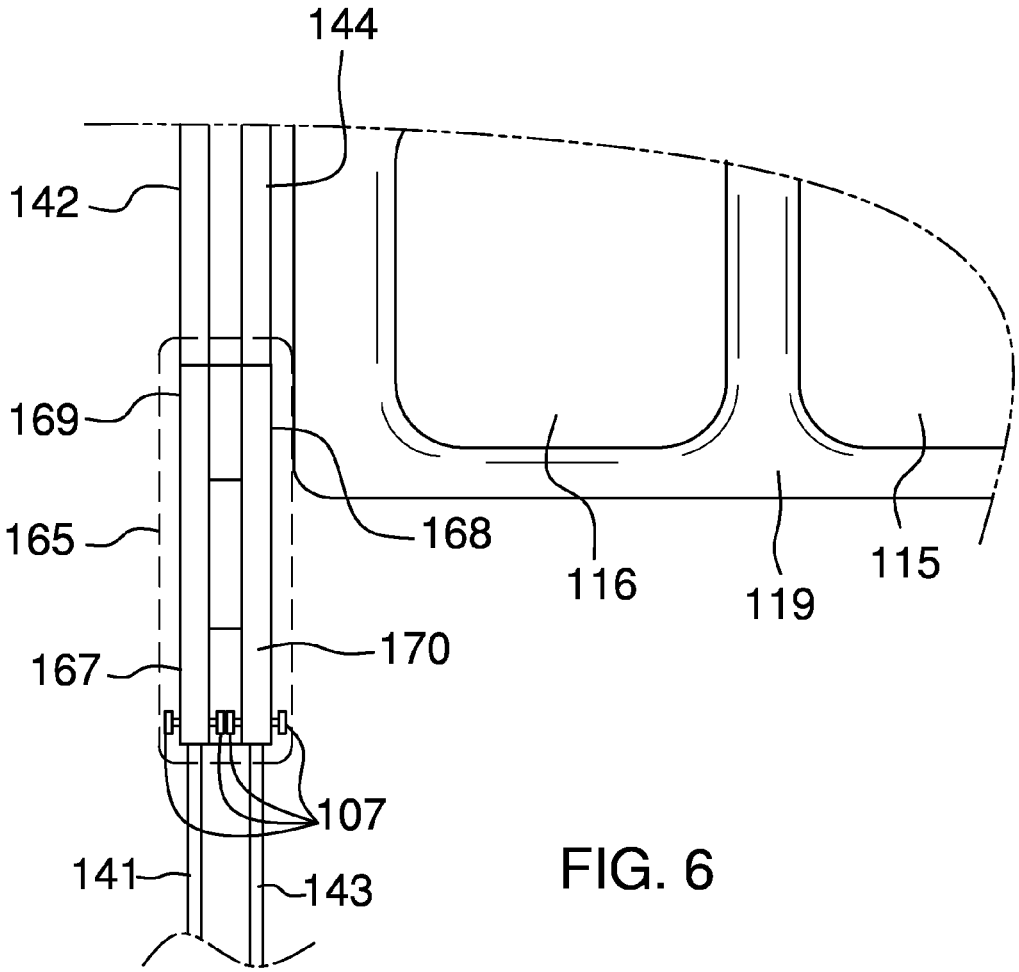
FIG. 6 is a detail view of an embodiment of the disclosure.
Figure 7:
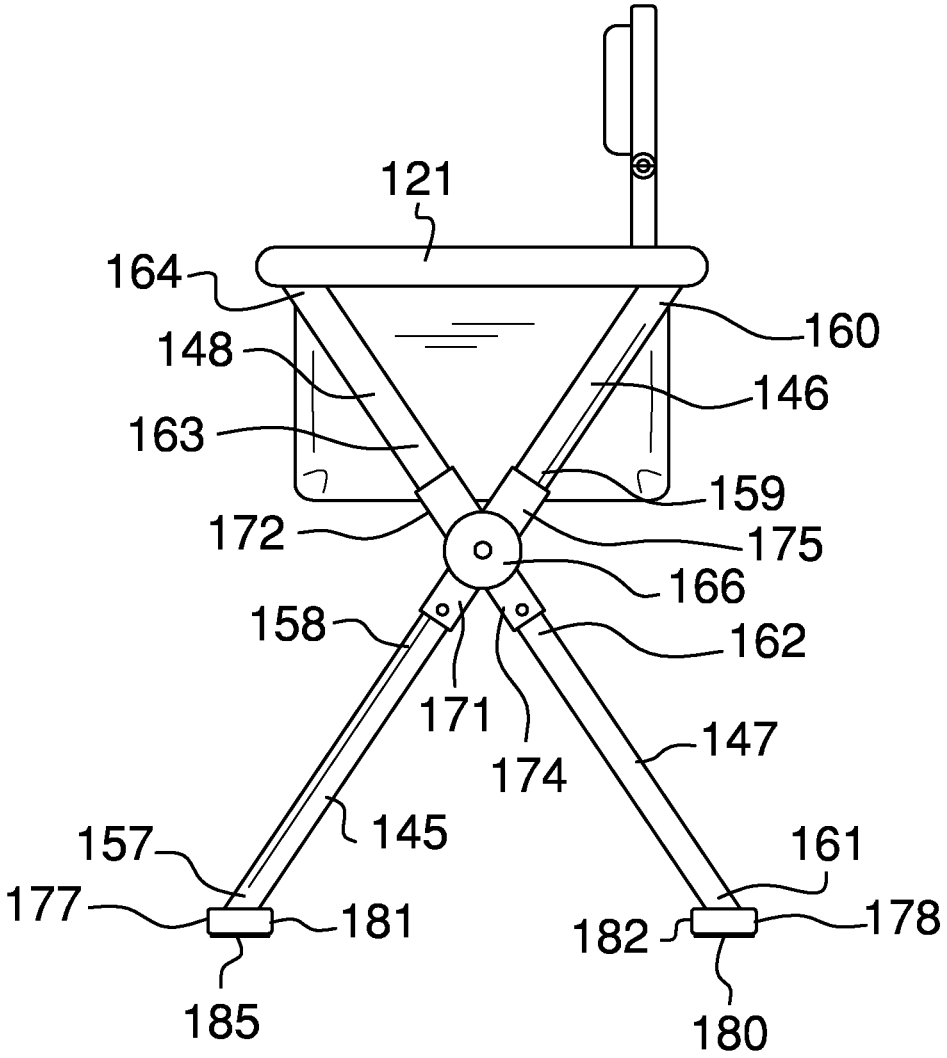
FIG. 7 is a side view of an embodiment of the disclosure.

The plurality of T connectors 104 further comprises a twenty fifth T connector 165 and a twenty sixth T connector 166. The twenty fifth T connector 165 is further defined with a twenty seventh end 167, a twenty eighth end 168, a twenty ninth end 169 and a thirtieth end 170. The twenty sixth T connector 166 is further defined with a thirty first end 171, a thirty second end 172, a thirty third end 173, and a thirty fourth end 174. The twenty fifth T connector 165 is shown in FIG. 6.

To assemble the invention 100, the twelfth 152 end of the second strut 142 is attached to the right ridge 122. The eleventh end 151 is of the second strut 142 is attached to the twenty ninth end 169 of the twenty fifth T connector 165. The sixteenth end 156 of the fourth strut 144 is attached to the right ridge 122. The fifteenth end 155 of the fourth strut 144 is attached to the twenty eighth end 168 of the twenty fifth T connector 165. The tenth end 150 of the first strut 141 is attached to the twenty seventh end 167 of the twenty fifth T connector 165. The fourteenth end 154 of the third strut 143 is attached to the thirtieth end 170 of the twenty fifth T connector 165. The twentieth end 160 of the sixth strut 146 is attached to the left ridge 121. The nineteenth end 159 of the sixth strut 146 is attached to the thirty third 173 end of the twenty sixth T connector 166. The twenty fourth end 164 of the eighth strut 148 is attached to the left ridge 121. The twenty third end 163 of the eighth strut 148 is connected to the thirty second end 172 of the twenty sixth T connector 166. The eighteenth end 158 of the fifth strut 145 is attached to the thirty first end 171 of the twenty sixth T connector 166. The twenty second end 162 of the seventh strut 147 is attached to the thirty fourth end 174 of the twenty sixth T connector 166. The attachments described in this paragraph can be done with commercially available hardware.

The attachment of the tenth end 150 to the twenty fifth T connector 165, the fourteenth end 154 to the twenty fifth T connector 165, the eighteenth end 158 to the twenty sixth T connector 166 and the twenty second end 162 to the twenty sixth T connector 166 is accomplished using a plurality of thumb screws 107. This allows for the adjustment of the height of the invention 100. By loosening the plurality of thumbscrews 107 a caregiver can lower the height of the invention 100 by: 1) inserting the first strut further into the second strut 142; 2) inserting the third strut 143 further into the fourth strut 144; 3) inserting the fifth strut 145 further into the sixth strut 146; 4) inserting the seventh strut 147 further into the eighth strut 148; and, 5) retightening the plurality of thumbscrews 107. By pulling the first strut 141, third strut 143, fifth strut 145 and seventh strut 147 further out of the second strut 142, fourth strut 144, sixth strut 146 and eighth strut 148 respectively, the height of the invention 100 can be increased.

The plurality of nonskid feet 105 further comprises a thirty fifth base 175, a thirty sixth base 176, a thirty seventh base 177, and a thirty eighth base 178. The thirty fifth base 175 further comprises a thirty ninth footpad 179 and a forty third foot 183. The thirty ninth footpad 179 is a small disc that is attached to the ninth end 149 of the first strut 141. On the face of the disc distal from the ninth end 149 of the first strut 141 is mounted the forty third foot 183. The forty third foot 183 is a nonskid pad that helps to keep the invention 100 in position. The thirty sixth base 176 further comprises a fortieth footpad pad 180 and a forty fourth foot 184. The fortieth footpad pad 180 is a small disc that is attached to the thirteenth end 153 of the third strut 143. On the face of the disc distal from the thirteenth end 153 of the third strut 143 is mounted the forty fourth foot 184. The forty fourth foot 184 is a nonskid pad that helps to keep the invention 100 in position. The thirty seventh base 177 further comprises a forty first footpad 181 and a forty fifth foot 185. The forty first footpad 181 is a small disc that is attached to the seventeenth end 157 of the fifth strut 145. On the face of the disc distal from the seventeenth end 157 of the fifth strut 145 is mounted the forty fifth foot 185. The forty fifth foot 185 is a nonskid pad that helps to keep the invention 100 in position. The thirty eighth base 178 further comprises a forty second footpad 182 and a forty sixth foot 186. The forty second footpad 182 is a small disc that is attached to the twenty first end 161 of the seventh strut 147. On the face of the disc distal from the twenty first end 161 of the seventh strut 147 is mounted the forty sixth foot 186. The forty sixth foot 186 is a nonskid pad that helps to keep the invention 100 in position.

To use the invention 100, the invention 100 is first set to the desired height. This is done by loosening the plurality of thumb screws 107 and: 1) inserting or extending the relative position of the first strut 141 within the second strut 142; 2) inserting or extending the relative position of the third strut 143 within the fourth strut 144; 3) inserting or extending the relative position of the fifth strut 145 within the sixth strut 146; and, 4) inserting or extending the relative position of the seventh strut 147 within the eighth strut 148. After that is complete, the plurality of thumbscrews 107 is tightened. The invention 100 then placed with the bathtub 132. The infant 131 is then placed in the seat frame 102 and secured using the seatbelt 106. The infant 131 can then be bathed.

The structure 101 is formed from molded plastic. Suitable plastics include, but are not limited to, polyethylene, polyvinylchloride, or polycarbonate. The seatbelt 106, plurality of struts 103, plurality of T connectors 104, plurality of nonskid feet 105, and seat frame 102 are all constructed from commercially available materials.

The following definitions were used in this disclosure:

Center: As used in this disclosure, a center is a point that is: 1) the point within a circle that is equidistant from all the points of the circumference; 2) the point within a regular polygon that is equidistant from all the vertices of the regular polygon; or, 3) the point, pivot, or axis around which something revolves.

The following directional references were used in this disclosure: All directional references refer to an infant 131 sitting in the invention 100. The left 133 side of the invention 100 is proximal to the left 133 side of the infant 131. The right 134 side of the invention 100 is proximal to the right 134 side of the infant 131. The infant 131 with their face facing the front 135 of the invention 100. The side of the invention 100 distal from the front 135 of the invention 100 is the rear of the invention 100. The side of the invention 100 proximal to the water of the bath 131 is the bottom 138 of the invention 100. The side of the invention 100 distal from the bottom 138 of the invention 100 is the top 137 of the invention 100.

With respect to the above description, it is to be realized that the optimum dimensional relationship for the various components of the invention described above and in FIGS. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. A bathing chair comprising:

a structure, a seat frame, a plurality of struts, a plurality of T connectors, a plurality of nonskid feet, and a seatbelt;

wherein the bathing chair is adapted for use in a bathtub;

wherein the bathing chair is adapted for use by an infant;

wherein the seat frame further comprises canvas;

wherein the structure is fabricated as an open rectangular block;

wherein the structure is constructed with a left wall, a right wall, a front wall and a back wall;

wherein the structure has an open top;

wherein the structure has an open bottom;

wherein the front wall is formed as a rectangular plate that has formed in it a left leg hole and a right leg hole;

wherein the left wall is formed with a left ridge;

wherein the right wall is formed with a right ridge;

wherein the seat frame is mounted into the interior of the structure;

wherein the seat frame further comprises a canvas seat, a canvas back support, and the headrest;

wherein the plurality of struts further comprises a first strut, a second strut, a third strut, a fourth strut, a fifth strut, a sixth strut, a seventh strut, and an eighth strut;

wherein the first strut is further defined with a ninth end and a tenth end;

wherein the second strut is further defined with an eleventh end and a twelfth end;

wherein the third strut is further defined with a thirteenth end and a fourteenth end;

wherein the fourth strut is further defined with a fifteenth end and a sixteenth end;

wherein the fifth strut is further defined with a seventeenth end and an eighteenth end;

wherein the sixth strut is further defined with a nineteenth end and a twentieth end;

wherein the seventh strut is further defined with a twenty first end and a twenty second end;

wherein the eighth strut is further defined with a twenty third end and a twenty fourth end.

2. The bathing chair according to claim 1 wherein the first strut is sized to fit inside the second strut;

wherein the third strut is sized to fit within the fourth strut;

wherein the fifth strut is sized to fit within the sixth strut;

wherein the seventh strut is sized to fit into the eighth strut.

3. The bathing chair according to claim 2 wherein the plurality of T connectors further comprises a twenty fifth T connector and a twenty sixth T connector;

wherein the twenty fifth T connector is further defined with a twenty seventh end, a twenty eighth end, a twenty ninth end and a thirtieth end;

wherein the twenty sixth T connector is further defined with a thirty first end, a thirty second end, a thirty third end, and a thirty fourth end.

4. The bathing chair according to claim 3 wherein the twelfth end of the second strut is attached to the right ridge;

wherein the eleventh end is of the second strut is attached to the twenty ninth end of the twenty fifth T connector;

wherein the sixteenth end of the fourth strut is attached to the right ridge;

wherein the fifteenth end of the fourth strut is attached to the twenty eighth end of the twenty fifth T connector;

wherein the tenth end of the first strut is attached to the twenty seventh end of the twenty fifth T connector;

wherein the fourteenth end of the third strut is attached to the thirtieth end of the twenty fifth T connector;

wherein the twentieth end of the sixth strut is attached to the left ridge;

wherein the nineteenth end of the sixth strut is attached to the thirty third end of the twenty sixth T connector;

wherein the twenty fourth end of the eighth strut is attached to the left ridge;

wherein the twenty third end of the eighth strut is connected to the thirty second end of the twenty sixth T connector;

wherein the eighteenth end of the fifth strut is attached to the thirty first end of the twenty sixth T connector;

wherein the twenty second end of the seventh strut is attached to the thirty fourth end of the twenty sixth T connector.

5. The bathing chair according to claim 4 wherein the bathing chair further comprises a plurality of thumbscrews;

wherein one or more thumbscrews are selected from the plurality of thumbscrews to attach the tenth end to the twenty fifth T connector;

wherein one or more thumbscrews are selected from the plurality of thumbscrews to attach the fourteenth end to the twenty fifth T connector;

wherein one or more thumbscrews are selected from the plurality of thumbscrews to attach the eighteenth end to the twenty sixth T connector;

wherein one or more thumbscrews are selected from the plurality of thumbscrews to attach the twenty second end to the twenty sixth T connector.

6. The bathing chair according to claim 5 wherein the plurality of nonskid feet further comprises a thirty fifth base, a thirty sixth base, a thirty seventh base, and a thirty eighth base.

7. The bathing chair according to claim 6 wherein the thirty fifth base further comprises a thirty ninth footpad and a forty third foot;

wherein the thirty sixth base further comprises a fortieth footpad pad and a forty fourth foot;

wherein the thirty seventh base further comprises a forty first footpad and a forty fifth foot;

wherein the thirty eighth base further comprises a forty second footpad and a forty sixth foot.

8. The bathing chair according to claim 7 wherein the thirty ninth footpad is a thirty ninth disc that is attached to the ninth end;

wherein the fortieth footpad pad is a fortieth disc that is attached to the thirteenth end;

wherein the forty first footpad is a forty first disc that is attached to the seventeenth end;

wherein the forty second footpad is a forty second disc that is attached to the twenty first end.

9. The bathing chair according to claim 8 wherein on the face of the thirty ninth disc distal from the ninth end is mounted the forty third foot;

wherein on the face of the fortieth disc distal from the thirteenth end is mounted the forty fourth foot;

wherein on the face of the forty first disc distal from the seventeenth end is mounted the forty fifth foot;

wherein on the face of the forty second disc distal from the twenty first end is mounted the forty sixth foot;

a seatbelt.

* * * * *